US011262026B2

(12) United States Patent
Lansky et al.

(10) Patent No.: US 11,262,026 B2
(45) Date of Patent: Mar. 1, 2022

(54) CRYOGENIC LIQUID DISPENSING SYSTEM HAVING A RAISED BASIN

(71) Applicant: Chart Inc., Ball Ground, GA (US)

(72) Inventors: Martin Lansky, Ceska Kamenice (CZ); Jan Kubica, Liberec (CZ)

(73) Assignee: Chart Inc., Ball Ground, GA (US)

( * ) Notice: Subject to any disclaimer, the term of this patent is extended or adjusted under 35 U.S.C. 154(b) by 60 days.

(21) Appl. No.: 16/570,174

(22) Filed: Sep. 13, 2019

(65) Prior Publication Data

US 2020/0182409 A1 Jun. 11, 2020

Related U.S. Application Data

(60) Provisional application No. 62/776,688, filed on Dec. 7, 2018, provisional application No. 62/791,285, filed on Jan. 11, 2019.

(51) Int. Cl.
*F17C 9/00* (2006.01)

(52) U.S. Cl.
CPC ..... *F17C 9/00* (2013.01); *F17C 2201/0109* (2013.01); *F17C 2201/035* (2013.01); *F17C 2205/0323* (2013.01); *F17C 2205/0352* (2013.01); *F17C 2221/033* (2013.01); *F17C 2223/0161* (2013.01); *F17C 2227/0135* (2013.01); *F17C 2265/065* (2013.01)

(58) Field of Classification Search
CPC ..... F17C 9/00; F17C 2201/035; F17C 2205/0323; F17C 2205/0352; F17C 2223/0161; F17C 2227/0135; F17C 2265/065; F17C 2265/063; F17C 2201/0109; F17C 2221/033
USPC ..... 62/50.1
See application file for complete search history.

(56) References Cited

U.S. PATENT DOCUMENTS 1,953,467 A * 4/1934 Dana ..... F17C 7/04 62/48.1
2,402,355 A * 6/1946 Whaley, Jr. ..... G01F 15/02 62/49.1
2,729,068 A * 1/1956 Mitchell ..... F17C 7/04 431/41
3,298,383 A * 1/1967 Cooper ..... G05D 11/001 137/3
3,798,918 A * 3/1974 Maher ..... F25J 3/067 62/637

(Continued)

FOREIGN PATENT DOCUMENTS

EP 3199859 A1 8/2017

OTHER PUBLICATIONS

European Search Report from the European Patent Office for EPO Application No. EP19214085.3, dated Apr. 21, 2020 (8 pages total).

*Primary Examiner* — Timothy L Maust
*Assistant Examiner* — James R Hakomaki
(74) *Attorney, Agent, or Firm* — Cook Alex Ltd.

(57) ABSTRACT

A cryogenic liquid dispensing system having a tank that holds cryogenic liquid and a basin configured to hold cryogenic liquid at a height above a bottom portion of the tank. The system is configured to pump cryogenic liquid for dispensing from the bottom portion of the tank when the cryogenic liquid in the tank is of a sufficient level to provide an adequate liquid head to permit pump operation, and is configured to pump cryogenic liquid for dispensing from the basin when the liquid in the tank is of an insufficient level to provide an adequate liquid head to permit pump operation to dispense cryogenic liquid.

20 Claims, 4 Drawing Sheets

(56) References Cited

U.S. PATENT DOCUMENTS 3,967,465 A * 7/1976 Asselman ..... C01B 3/0005 62/46.3
5,373,701 A * 12/1994 Siefering ..... F17C 9/02 62/48.1
5,404,918 A * 4/1995 Gustafson ..... F17C 6/00 141/1
5,421,162 A * 6/1995 Gustafson ..... F17C 9/02 123/525
5,682,750 A * 11/1997 Preston ..... F17C 9/00 62/50.2
5,685,159 A * 11/1997 Kooy ..... F17C 6/00 138/26
5,954,101 A 9/1999 Drube et al.
6,631,615 B2 10/2003 Drube et al.
6,640,554 B2 * 11/2003 Emmer ..... F17C 5/007 220/560.1
6,734,112 B2 * 5/2004 Worm ..... D06F 43/00 134/1.1
8,104,296 B2 * 1/2012 Harper ..... F17C 3/00 62/45.1
9,663,345 B2 * 5/2017 Mackey ..... F04D 13/14
9,746,132 B2 * 8/2017 Gustafson ..... F02M 21/0221
10,006,697 B2 6/2018 Varrassi
2005/0274127 A1 12/2005 Drube et al.
2008/0078782 A1 * 4/2008 Bien ..... B01F 15/042 222/139
2008/0184735 A1 8/2008 van Wijngaarden et al.
2011/0223308 A1 * 9/2011 Motzaeli ..... C12G 3/005 426/575
2015/0219279 A1 * 8/2015 Pelger ..... F17C 5/06 141/4
2017/0108170 A1 * 4/2017 Gustafson ..... F17C 7/04
2018/0202609 A1 * 7/2018 Madison ..... F17C 7/02
2020/0096157 A1 * 3/2020 Kim ..... F17C 13/002

* cited by examiner

CRYOGENIC LIQUID DISPENSING SYSTEM HAVING A RAISED BASIN

CLAIM OF PRIORITY

This application claims the benefit of U.S. Provisional Application No. 62/776,688, filed Dec. 7, 2018, and U.S. Provisional Application No. 62/791,285, filed Jan. 11, 2019, the contents of both of which are hereby incorporated by reference.

FIELD OF THE INVENTION

The present disclosure relates generally to cryogenic liquid dispensing systems and, in particular, to a cryogenic liquid dispensing system having a tank and a raised basin that permits more of the liquid in the tank to be dispensed.

BACKGROUND

Cryogenic fluids, that is, fluids having a boiling point generally below −150° C. at atmospheric pressure, are used in a variety of applications, such as mobile and industrial applications. Cryogenic fluids typically are stored as liquids to reduce volume and thus permit containers of more practical and economical design to be used. The liquids are often stored in double-walled bulk tanks or containers with a vacuum between the walls of inner and outer vessels as insulation to reduce heat transfer from the ambient environment into the cryogenic liquid.

Dispensing of the cryogenic liquid, such as liquefied natural gas (LNG), typically is requested intermittently, for example, when an LNG fueled vehicle comes to an LNG fueling station to refuel. During dispensing, the cryogenic liquid may be removed from a tank by use of a pump. The pump normally is submerged in cryogenic liquid in a separate vessel, to ensure adequate cooling of the pump. The pump requires a certain liquid pressure head, or liquid head, to prime, start and run. This liquid head usually is referred to as a required Net Positive Suction Head (NPSH), and it is a design parameter of the pump.

An example prior art configuration of a cryogenic liquid dispensing system 10 is shown schematically in FIG. 1, as an LNG refueling station. The cryogenic liquid dispensing system 10 includes a horizontal tank 12 (a tank having a horizontal cross-sectional area that is greater than its vertical cross-sectional area) that contains a supply of cryogenic liquid 14 with a vapor headspace 16 above the cryogenic liquid 14. A supply conduit or line 18 is connected at a first end 18*a* to the bottom of the tank 12 and is connected at a second end 18*b* to a pump 20 that is submerged in a vessel 22. A supply valve 24 is installed within the supply line 18 between the first end 18*a* of the supply line 18 at the bottom of the tank 12 and the second end 18*b* of the supply line 18 at the pump 20. A recycle conduit or line 26 is connected at a first end 26*a* to the pump 20 and is connected at a second end 26*b* to the top of the tank 12. A recycle valve 28 is installed within the recycle line 26 between the first end 26*a* of the line 26 at the pump 20 and the second end 26*b* at the top of the tank 12. A dispensing conduit or line 30 is used to dispense the cryogenic liquid 14 and is connected to the recycle line 26 between the first end 26*a* at the pump 20 and the recycle valve 28. A dispensing valve 32 is installed in the dispensing line 30 to control the flow of dispensed cryogenic liquid 14.

When no dispensing of cryogenic liquid 14 is demanded, the pump 20 is not operating and is maintained in a cold state with the supply valve 24 in an open position. When dispensing of the cryogenic liquid 14 is demanded, the pump 20 is started in a recycle mode, with supply valve 24 and recycle valve 28 in open positions, while dispensing valve 32 is closed. Only when operation parameters are stable, the dispensing valve 32 opens and recycle valve 28 closes. The required amount of cryogenic liquid 14 then is delivered via the dispensing line 30 and dispensing valve 32. After the required amount of cryogenic liquid 14 has been dispensed, the pump 20 is stopped, the dispensing valve 32 is closed and the dispensing system 10 awaits the next dispensing event.

However, cryogenic liquid flowing in the supply line 18 connected to the tank 12 and pump 20 must overcome flow obstructions, including for example friction in the supply line, and direction and cross-section changes, which result in a pressure loss. This pressure loss is proportional to a square of the flow rate, and impacts the liquid column head required to meet the pump NPSH requirements. The liquid head is dependent upon the relative height X of the cryogenic liquid 14 in the tank 12 above the pump 20.

Thus, for the pump to operate reliably, the available liquid head established by the relative difference X in height at which the level of the cryogenic liquid 14 in the tank is above the suction point for the pump 14, must be greater than, or at least equal to a sum of the pump NPSH and the pressure loss. When the level of the cryogenic liquid 14 in the tank 12 is lower than the height needed to provide the liquid head required by the pump 20, the pump 20 cannot drive the liquid to dispense, and some portion of the cryogenic liquid 14 in the tank 12 cannot be utilized. While the liquid head could be increased by locating the entire tank 12 well above the pump 20, this would be undesirable due to the increased physical dimensions of the dispensing system. As such, cryogenic liquid dispensing systems commonly suffer from less than desirable utilization of the cryogenic liquid in the tank, resulting in a need to refill the tank when the liquid head, or residual cryogenic liquid in the tank, is a greater volume than desired.

SUMMARY

The example embodiments disclosed herein provide an advantageous cryogenic liquid dispensing system that overcomes disadvantages of the prior art dispensing systems. The disclosed cryogenic liquid dispensing system is able to provide greater utilization with respect to dispensing more of the cryogenic liquid from the tank than would otherwise be possible when pumping cryogenic fluid from the bottom of a tank. The system includes a raised basin which is located at a height above the bottom of the tank and which is utilized when the liquid head provided by the level of cryogenic liquid in the tank is insufficient for reliable operation of the pump. In such circumstances, the cryogenic liquid in the tank is pumped to the raised basin to establish a greater liquid head, and the cryogenic liquid then is pumped from the basin, thereby increasing the utilization of the cryogenic liquid in the tank.

In one aspect, a cryogenic liquid dispensing system is disclosed that includes a tank defining an area that holds cryogenic liquid, a basin defining an area configured to hold cryogenic liquid at a height above a bottom portion of the tank, and being in liquid communication with the tank, and a pump. The system further includes a first supply line in liquid communication with the bottom portion of the tank and the pump, a first supply valve located in the first supply line between the bottom portion of the tank and the pump, a recycle line in liquid communication with the pump and the basin, a recycle valve located in the recycle line between the pump and the basin, a dispensing line in liquid communication with the second line at a location between the pump and the recycle valve, a dispensing valve in the dispensing line, a second supply line in liquid communication with a bottom portion of the basin and the pump, and a second supply valve located in the second supply line between the bottom portion of the basin and the pump.

In another aspect, a method of dispensing a cryogenic liquid is disclosed that includes the steps of opening a first supply valve in a first supply line in liquid communication with a pump and a tank defining an area that holds cryogenic liquid, opening a recycle valve in a recycle line in liquid communication with the pump and a basin defining an area configured to hold cryogenic liquid, with the basin being at a height raised above a bottom portion of the tank and being in liquid communication with the tank, and pumping cryogenic liquid from the bottom of the tank through the first supply line and the recycle line to the basin. The method further including the steps of closing the recycle valve and opening a dispensing valve in a dispensing line that is in liquid communication with the recycle line at a location between the pump and the recycle valve with the level of the cryogenic liquid in the tank is sufficient to permit reliable operation of the pump for dispensing cryogenic liquid, and pumping cryogenic liquid from the bottom of the tank, through the first supply line and first supply valve, the pump, and the dispensing line and dispensing valve. The method further including the steps of when the level of cryogenic liquid in the tank drops below the level required for reliable operation of the pump for dispensing, closing the first supply valve and opening a second supply valve located in a second supply line in liquid communication with a bottom portion of the basin and the pump, and pumping cryogenic liquid from the bottom of the basin and through the second supply line and second supply valve, the pump, and the dispensing line and the dispensing valve.

In a further aspect, a cryogenic liquid dispensing system is disclosed that includes a tank defining an area that holds cryogenic liquid, a basin defining an area configured to hold cryogenic liquid at a height raised above a bottom portion of the tank, and being in liquid communication with the tank, and a first pump. The system further includes a first supply line in liquid communication with the bottom portion of the tank and the first pump, a first supply valve located in the first supply line between the bottom portion of the tank and the first pump, a recycle line in liquid communication with the first pump and an upper portion of the tank, a recycle valve located in the recycle line between the first pump and the upper portion of the tank, a dispensing line in liquid communication with the recycle line at a location between the first pump and the recycle valve, and a dispensing valve in the dispensing line. The system also includes a second supply line in liquid communication with a bottom portion of the basin and the first pump, a second supply valve located in the second supply line between the bottom portion of the basin and the first pump, a second pump that is relatively smaller than the first pump, a first recirculation line in liquid communication with the bottom portion of the tank and the second pump, a first recirculation valve located in the first recirculation line between the bottom portion of the tank and the second pump, and a second recirculation line in liquid communication with the second pump and the basin.

In yet another aspect, a cryogenic liquid dispensing system is disclosed that includes a tank defining an area that holds cryogenic liquid, a basin defining an area configured to hold cryogenic liquid at a height raised above a bottom portion of the tank, and being in liquid communication with the tank, and a first pump. The system further includes a first supply line in liquid communication with the bottom portion of the tank and the first pump, a first supply valve located in the first supply line between the bottom portion of the tank and the first pump, a second pump that is relatively smaller than the first pump, a recycle line in liquid communication with the bottom portion of the tank and the basin, and the second pump located in the recycle line between the bottom portion of the tank and the basin. The system also includes a recycle valve located in the recycle line between the bottom portion of the tank and the second pump, a second supply line in liquid communication with a bottom portion of the basin and the first pump, a second supply valve located in the second supply line between the bottom portion of the basin and the first pump, a dispensing line in liquid communication with the first pump, and a dispensing valve in the dispensing line.

It is to be understood that both the foregoing general description and the following detailed description are exemplary and provided for the purposes of explanation only, and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred example embodiments, references are made to the accompanying drawing figures wherein like parts have like reference numerals, and wherein.

It should be understood that the drawings are not to scale. While some mechanical details of example dispensing systems and of alternative configurations have not been included, such details are considered well within the comprehension of those of skill in the art in light of the present disclosure. It also should be understood that the present invention is not limited to the example embodiments shown.

DETAILED DESCRIPTION OF EMBODIMENTS

Figure 1:
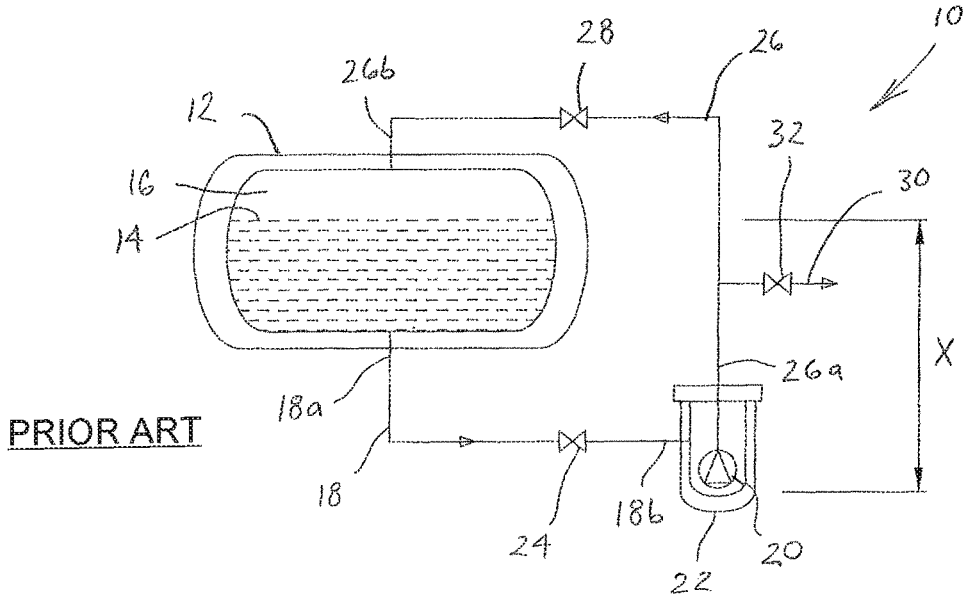
FIG. 1 is a schematic view of a prior art cryogenic liquid dispensing system.
Figure 2:
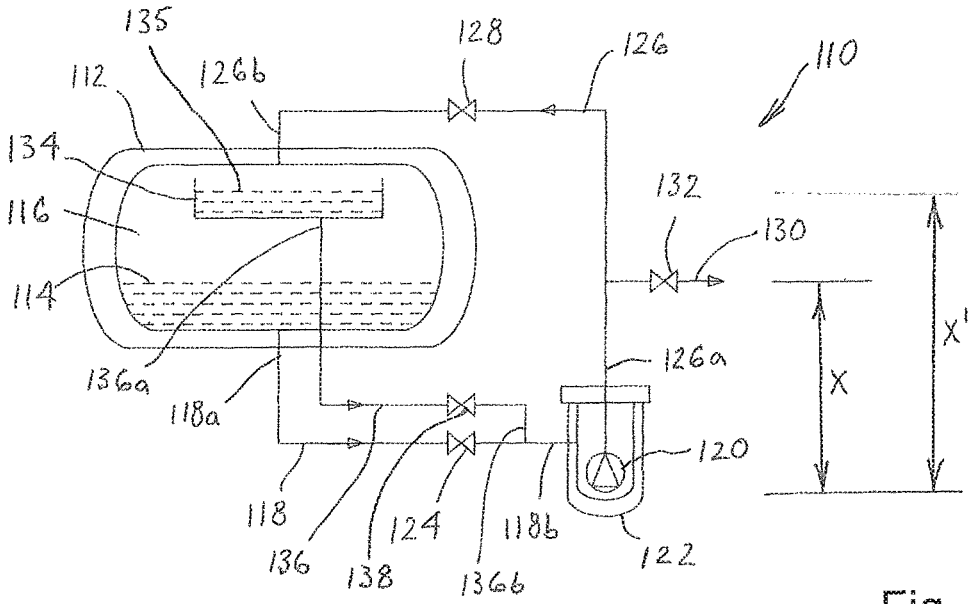
FIG. 2 is a schematic view of a first example embodiment of a cryogenic liquid dispensing system in accordance with the invention.

A first example embodiment of a cryogenic liquid dispensing system 110 configured in accordance with the invention is indicated in FIG. 2, shown schematically as an LNG refueling station. The cryogenic liquid dispensing system 110 includes a tank 112 defining an area that holds cryogenic liquid 114 with a vapor headspace 116 above the cryogenic liquid 114. A first supply conduit or line 118 is in liquid communication a first end 118*a* with a bottom portion of the tank 112 and is in liquid communication at a second end 118*b* with a pump 120 that is submerged in a separate vessel or sump 122. Liquid from tank 112 flows to sump 122 so as to be in liquid communication with the inlet of the pump 120 and to submerge the pump 120 in liquid to maintain adequate cooling of the pump 120. A first supply valve 124 is located in the first supply line 118 between the first end 118*a* of the first supply line 118 at the bottom portion of the tank 112 and the second end 118*b* of the first supply line 118 at the pump 120. One will appreciate that a liquid head is established by the relative difference X in height at which the level of the cryogenic liquid 114 in the tank 112 is above the suction point for the pump 120. Also, for the pump 120 to reliably operate, the liquid head must be greater than, or at least equal to a sum of the pump NPSH and the pressure loss experience by liquid flowing to the pump inlet.

A recycle conduit or line 126 is in liquid communication at a first end 126*a* with the pump 120 and is in liquid communication at a second end 126*b* with a basin 134 defining an area configured to hold cryogenic liquid 135 at a height raised above the bottom portion of the tank 112 and with the basin 134 being in liquid communication with the tank 112. The basin 134 is suspended within the tank 112 in an upper portion of the tank 112, and has an upward extending opening. A recycle valve 128 is located in the recycle line 126 between the first end 126*a* of the recycle line 126 at the pump 120 and the second end 126*b* at the basin 134.

A dispensing conduit or line 130 is in liquid communication with the recycle line 126 at a location between the first end 126*a* at the pump 120 and the recycle valve 128. A dispensing valve 132 is located in the dispensing line 130 to control the flow of dispensed cryogenic liquid 114.

A second supply conduit or line 136 is in liquid communication at a first end 136*a* with a bottom portion of the basin 134 and is in liquid communication at a second end 118*b* with a pump 120. A second supply valve 138 is located in the second supply line 136 between a first end 136*a* at the bottom portion of the basin 134 and the second end 136*b* at the pump 120. One will appreciate that when drawing cryogenic liquid from the basin 134 through the second supply line 136, the liquid head established by the relative difference X' in height at which the level of the cryogenic liquid 135 in the basin 134 is above the suction point for the pump 120 will be greater than the liquid head otherwise would be when the cryogenic liquid is at a low level within the tank 112. One also will appreciate that the first and second supply valves 124 and 138 optionally may be replaced with a three-way valve.

When no dispensing of cryogenic liquid 114 is demanded, the pump 120 is not operating and is maintained in a cold state by liquid in the sump 122 with the first supply valve 124 in an open position.

When dispensing of the cryogenic liquid 114 is demanded, the pump 120 is started in a recycle mode, with first supply valve 124 and recycle valve 128 in open positions and the dispensing valve 132 in the closed position, to permit pumping of the cryogenic liquid 114 from the bottom portion of the tank 112 to the basin 134. Cryogenic liquid that is circulated by the pump 120 is collected in the basin 134 until full. As additional pumped liquid enters the basin, overflowing liquid is directed to the interior portion of tank 112 positioned below the basin.

When the operation parameters of the system are stable, with the level of cryogenic liquid in the bottom portion of the tank 112 sufficient to provide a liquid head that will support reliable operation of the pump 120, the recycle valve 128 is closed and the dispensing valve 132 is opened. As illustrated in FIG. 2, the dispensing valve 132 is positioned in the dispensing line 130 which is in liquid communication with the recycle line 126 at a location between the pump 120 and the recycle valve 128. The required amount of cryogenic liquid 114 then is delivered via the dispensing line 130 and dispensing valve 132 as long as the level of cryogenic liquid in the bottom portion of the tank 112 is sufficient to provide a liquid head that will support reliable operation of the pump 120. After the required amount of cryogenic liquid 114 has been dispensed, the pump 120 is stopped, the dispensing valve 132 is closed and the dispensing system 110 awaits the next dispensing event.

However, when the level of cryogenic liquid 114 in the tank 112 drops below the level required for reliable operation of the pump 120 for dispensing, then the first supply valve 124 in the first supply line 118 is closed and the second supply valve 138 in the second supply line 136 that is in liquid communication with the bottom portion of the basin 134 and the pump 120 is opened. The liquid head now is based on the relative difference X' in height at which the level of the cryogenic liquid 135 in the basin 134 is above the suction point for the pump 120, and for the pump 120 to reliably operate, the liquid head must be greater than, or at least equal to a sum of the pump NPSH and the pressure loss. Cryogenic liquid then is pumped from the bottom portion of the basin 134 and through the second supply line 136 and the second supply valve 138, the pump 120, and the dispensing line 130 and dispensing valve 132.

When dispensing is completed, the dispensing valve 132 and the second supply valve 138 are closed. The first supply valve 124 and the recycle valve 128 are opened. The pump 120 is switched to a lower speed for operation in recycling mode. The lower speed means there will be a low flow-rate, for example, about one third of the dispensing flow-rate. The low pump speed and low flow-rate result in the suction line or second supply line 136 pressure loss being quite low. If the pressure loss in dispensing speed was 1 mb, then at low speed it would be ⅓^2=0.11 mb. As a result, at the lower speed of operation of the pump, the lower liquid level in the tank 112 is sufficient to meet the NPSH requirements of the pump. When the basin 134 is full, the pump 120 is stopped and the dispensing system waits the next refueling request, which will be fulfilled using liquid from the basin 134. This enables significantly greater utilization of the cryogenic liquid in a tank, without requiring increased physical dimensions of the dispensing system.

Thus, a method of dispensing a cryogenic liquid is disclosed with the cryogenic liquid dispensing system 110 herein and may be explained as including the steps of opening a first supply valve 124 in a first supply line 118 in liquid communication with a pump 120 and a tank 112 defining an area that holds cryogenic liquid 114, opening a recycle valve 128 in a recycle line 126 in liquid communication with the pump 120 and a basin 134 defining an area configured to hold cryogenic liquid, with the basin 134 being at a height raised above a bottom portion of the tank 112 and being in liquid communication with the tank 112, and pumping cryogenic liquid from the bottom of the tank 112 through the first supply line 118 and the recycle line 126 to the basin 134, with overflowing liquid traveling to the interior space of the tank 112 below.

The method further includes the steps of, when the operation parameters of the system are stable and the level of the cryogenic liquid in the tank 112 is sufficient to permit reliable operation of the pump 120 for dispensing cryogenic liquid, closing the recycle valve 128 and opening a dispensing valve 132 in a dispensing line 130 that is in liquid communication with the recycle line 126 at a location between the pump 120 and the recycle valve 128, and pumping cryogenic liquid from the bottom of the tank 112, through the first supply line 118 and first supply valve 124, the pump 120, and the dispensing line 130 and dispensing valve 132.

The method further includes the steps of when the level of cryogenic liquid in the tank 112 drops below the level required for reliable operation of the pump 120 for dispensing, closing the first supply valve 124 and opening a second supply valve 138 located in a second supply line 136 in liquid communication with a bottom portion of the basin 134 and the pump 120, and pumping cryogenic liquid from the bottom of the basin 134 and through the second supply line 136 and second supply valve 138, the pump 120, and the dispensing line 130 and dispensing valve 132. The method further includes the steps of, when dispensing from the basin 134 is completed, closing the dispensing valve 132 and the second supply valve 138, opening the first supply valve 124 and the recycle valve 128, and switching the pump 120 to a lower speed and operating in recycling mode pumping liquid from the bottom portion of the tank 112 to the basin. When the basin is full, the pump may be stopped.

FIGS. 3-8 provide a few alternative portions of the first example embodiment shown in FIG. 2, which operate by similar principles but include portions structured differently from the example shown in FIG. 2. Relative to the example shown in FIG. 2, the examples shown in FIGS. 3-8 are intended to operate with the same pump, recycle line and recycle valve, and the same dispensing line and dispensing valve. The examples in FIGS. 3-8 differ with respect to the configurations of the tank, basin and second supply line, but each still includes a second supply line and second supply valve, while the first supply line and first supply valve, are essentially the same as in the first example shown in FIG. 2.

Figure 3:
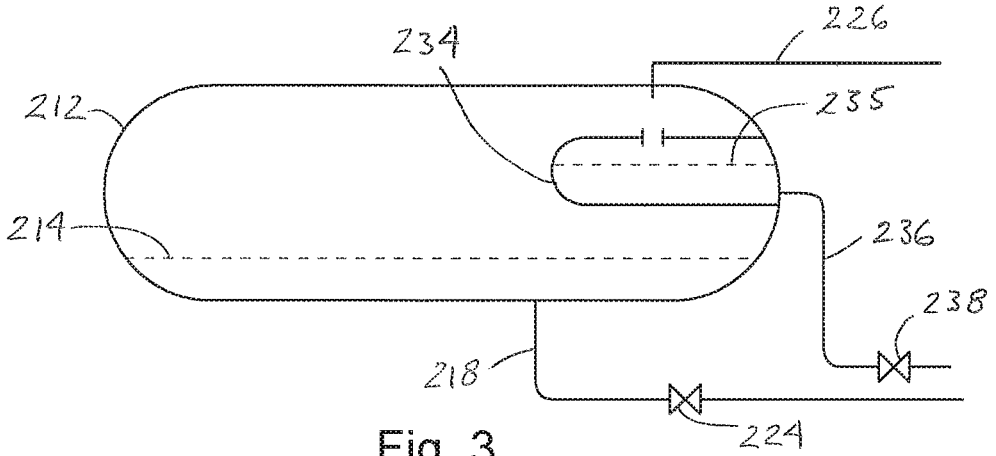
FIG. 3 is a schematic view of a first alternative portion of the first example embodiment of a cryogenic liquid dispensing system shown in FIG. 2.

In FIG. 3, the tank 212 defines an area that holds cryogenic liquid 214 and includes a basin 234 that defines an area configured to hold cryogenic liquid 235 at a height raised above the bottom portion of the tank 212. The basin 234 is suspended from a side wall of the tank 212 and includes an opening in an upper portion of the basin 234, with the basin 234 having the potential to hold cryogenic liquid at a higher level than the bottom portion of the tank 212. The first supply line 218 and first supply valve 224 are in liquid communication with the bottom portion of the tank 212, while the second supply line 236 and second supply valve 238 are in liquid communication with a bottom portion of the basin 234, and the recycle line 226 directs pumped fluid to the basin 234 through an upper portion of the tank 212 and an upward opening in the basin 234. As in the first example embodiment, one will appreciate that the first and second supply valves 224 and 238 optionally may be replaced with a three-way valve. A cryogenic liquid dispensing system incorporating these alternative components would be operated via the same method and using the same pumping and dispensing components disclosed above for the cryogenic liquid dispensing system 110.

Figure 4:
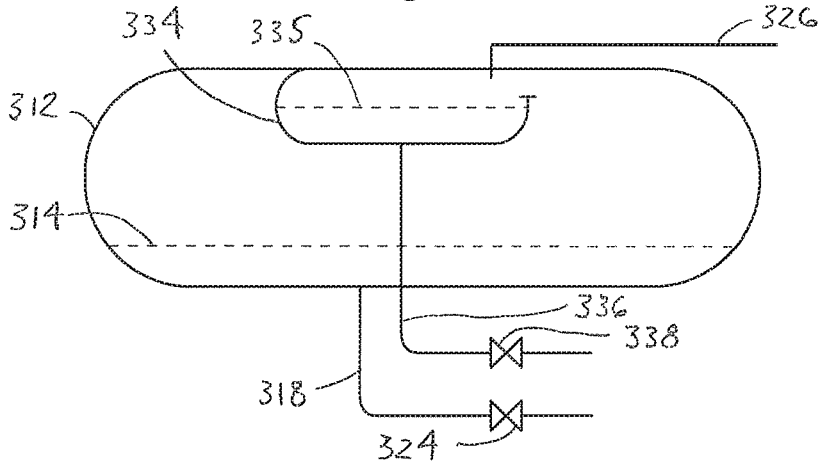
FIG. 4 is a schematic view of a second alternative portion of the first example embodiment of a cryogenic liquid dispensing system shown in FIG. 2.

In FIG. 4, the tank 312 defines an area that holds cryogenic liquid 314 and includes a basin 334 that defines an area configured to hold cryogenic liquid 335 at a height raised above the bottom portion of the tank 312. The basin 334 is suspended from a top wall of the tank 312 and includes an opening in an upper portion of the basin 334, with the basin 334 having the potential to hold cryogenic liquid at a higher level than the bottom portion of the tank 312. The first supply line 318 and first supply valve 324 are in liquid communication with the bottom portion of the tank 312, while the second supply line 336 and second supply valve 338 are in liquid communication with a bottom portion of the basin 334, and the recycle line 326 directs pumped fluid to the basin 334 through an upper portion of the tank 312 and an upward opening in the basin 334. As in the first example embodiment, one will appreciate that the first and second supply valves 324 and 338 optionally may be replaced with a three-way valve. A cryogenic liquid dispensing system incorporating these alternative components would be operated via the same method as disclosed above for the cryogenic liquid dispensing system 110.

Figure 5:
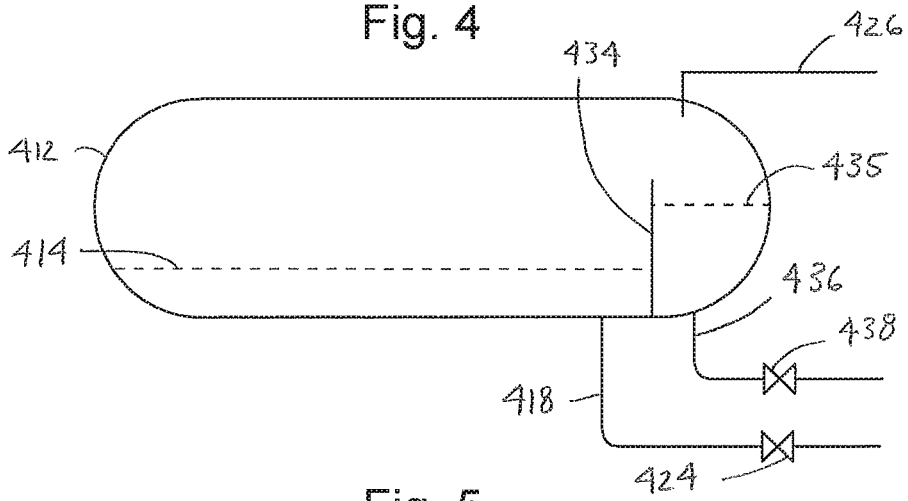
FIG. 5 is a schematic view of a third alternative portion of the first example embodiment of a cryogenic liquid dispensing system shown in FIG. 2.

In FIG. 5, the tank 412 defines an area that holds cryogenic liquid 414 and includes a basin 434 that defines an area configured to hold cryogenic liquid 435 at a height raised above the bottom portion of the tank 412. The basin 434 incorporates a side wall of the tank 412 and includes an opening in an upper portion of the basin 434, with the basin having the potential to hold cryogenic liquid at a higher level than the bottom portion of the tank 412. The first supply line 418 and first supply valve 424 are in liquid communication with the bottom portion of the tank 412, while the second supply line 436 and second supply valve 438 are in liquid communication with a bottom portion of the basin 434, and the recycle line 426 directs pumped fluid to the basin 434 through an upper portion of the tank 412 and an upward opening in the basin 434. As in the first example embodiment, one will appreciate that the first and second supply valves 424 and 438 optionally may be replaced with a three-way valve. A cryogenic liquid dispensing system incorporating these alternative components would be operated via the same method and using the same pumping and dispensing components disclosed above for the cryogenic liquid dispensing system 110.

Figure 6:
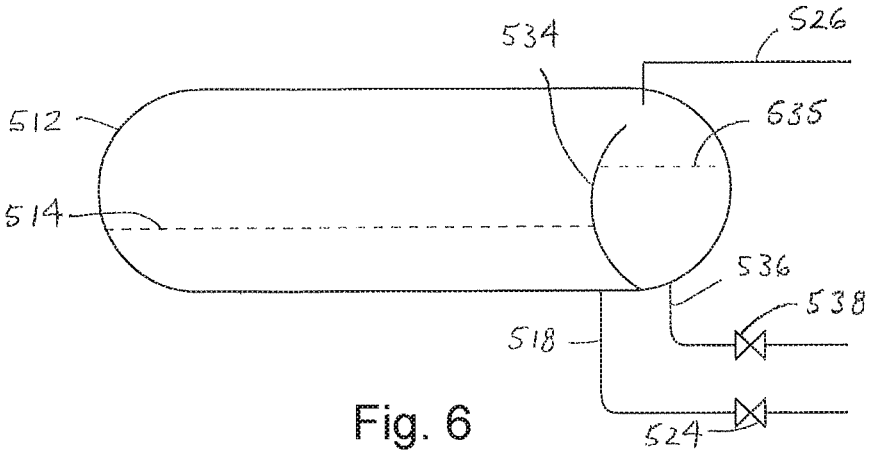
FIG. 6 is a schematic view of a fourth alternative portion of the first example embodiment of a cryogenic liquid dispensing system shown in FIG. 2.

In FIG. 6, the tank 512 defines an area that holds cryogenic liquid 514 and includes a basin 534 that defines an area configured to hold cryogenic liquid 535 at a height raised above the bottom portion of the tank 512. The basin 534 incorporates a side wall of the tank 512 and includes an opening in an upper portion of the basin 534, with the basin having the potential to hold cryogenic liquid at a higher level than the bottom portion of the tank 512. The first supply line 518 and first supply valve 524 are in liquid communication with the bottom portion of the tank 512, while the second supply line 536 and second supply valve 538 are in liquid communication with a bottom portion of the basin 534, and the recycle line 526 directs pumped fluid to the basin 534 through an upper portion of the tank 512 and an upward opening in the basin 534. As in the first example embodiment, one will appreciate that the first and second supply valves 524 and 538 optionally may be replaced with a three-way valve. A cryogenic liquid dispensing system incorporating these alternative components would be operated via the same method and using the same pumping and dispensing components disclosed above for the cryogenic liquid dispensing system 110.

Figure 7:
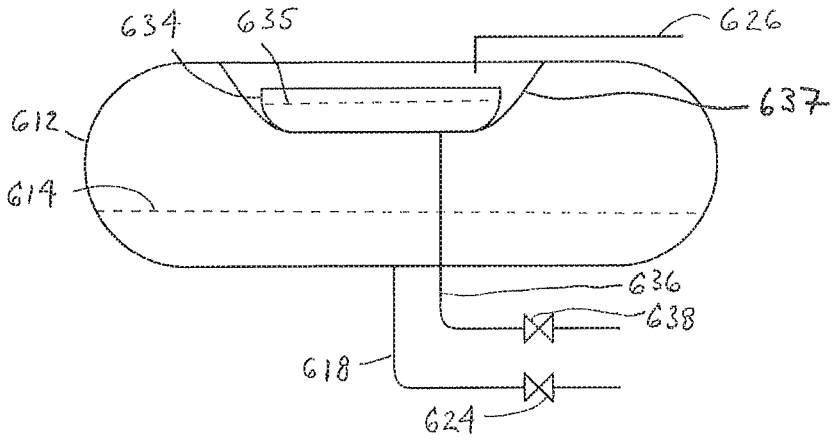
FIG. 7 is a schematic view of a fifth alternative portion of the first example embodiment of a cryogenic liquid dispensing system shown in FIG. 2.

In FIG. 7, the tank 612 defines an area that holds cryogenic liquid 614 and includes a basin 634 that defines an area configured to hold cryogenic liquid 635 at a height raised above the bottom portion of the tank 612. The basin 634 is suspended by a web 637 from a top wall of the tank 612 and includes an opening in an upper portion of the basin 634, with the basin 634 having the potential to hold cryogenic liquid at a higher level than the bottom portion of the tank 612. The first supply line 618 and first supply valve 624 are in liquid communication with the bottom portion of the tank 612, while the second supply line 636 and second supply valve 638 are in liquid communication with a bottom portion of the basin 634, and the recycle line 626 directs pumped fluid to the basin 634 through an upper portion of the tank 612 and an upward opening in the basin 634. As in the first example embodiment, one will appreciate that the first and second supply valves 624 and 638 optionally may be replaced with a three-way valve. A cryogenic liquid dispensing system incorporating these alternative components would be operated via the same method and using the same pumping and dispensing components disclosed above for the cryogenic liquid dispensing system 110.

Figure 8:
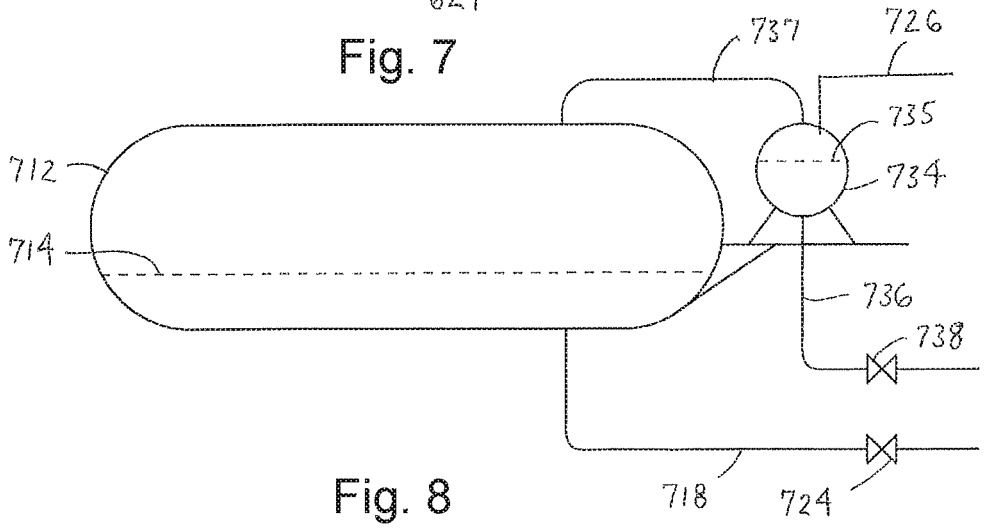
FIG. 8 is a schematic view of a sixth alternative portion of the first example embodiment of a cryogenic liquid dispensing system shown in FIG. 2.

In FIG. 8, the cryogenic liquid dispensing system components include a tank 712 defining an area that holds cryogenic liquid 714 and includes a basin 734 defining an area configured to hold cryogenic liquid 735 at a height raised above the bottom portion of the tank 712. The basin 734 is suspended externally from a side wall of the tank 712 (or from another structure independent of tank 712), with the basin 734 having the potential to hold cryogenic liquid at a higher level than the bottom portion of the tank 712. The basin 734 is located at a height above the bottom portion of the tank 712, so as to be able to be used to generate an adequate liquid head to pump, even when the level of the cryogenic liquid in the tank 712 would otherwise be too low to do so. The basin 734 has a conduit or overflow line 737 that permits cryogenic liquid entering the basin 734 via a recycle line 726 to overflow into the tank 712, if the level in the basin 734 exceeds its volume. The first supply line 718 and first supply valve 724 are in liquid communication with the bottom portion of the tank 712, while the second supply line 736 and second supply valve 738 are in liquid communication with a bottom portion of the basin 734, and the recycle line 726 directs pumped fluid to the basin 734 through an upper portion of the basin 734. As in the first example embodiment, one will appreciate that the first and second supply valves 724 and 738 optionally may be replaced with a three-way valve. But for the variation of the transfer of cryogenic fluid from the basin 734 via the overflow line 737 to the tank 712, a cryogenic liquid dispensing system incorporating these alternative components would be operated via the same method and using the same pumping and dispensing components disclosed above for the cryogenic liquid dispensing system 110.

Figure 9:
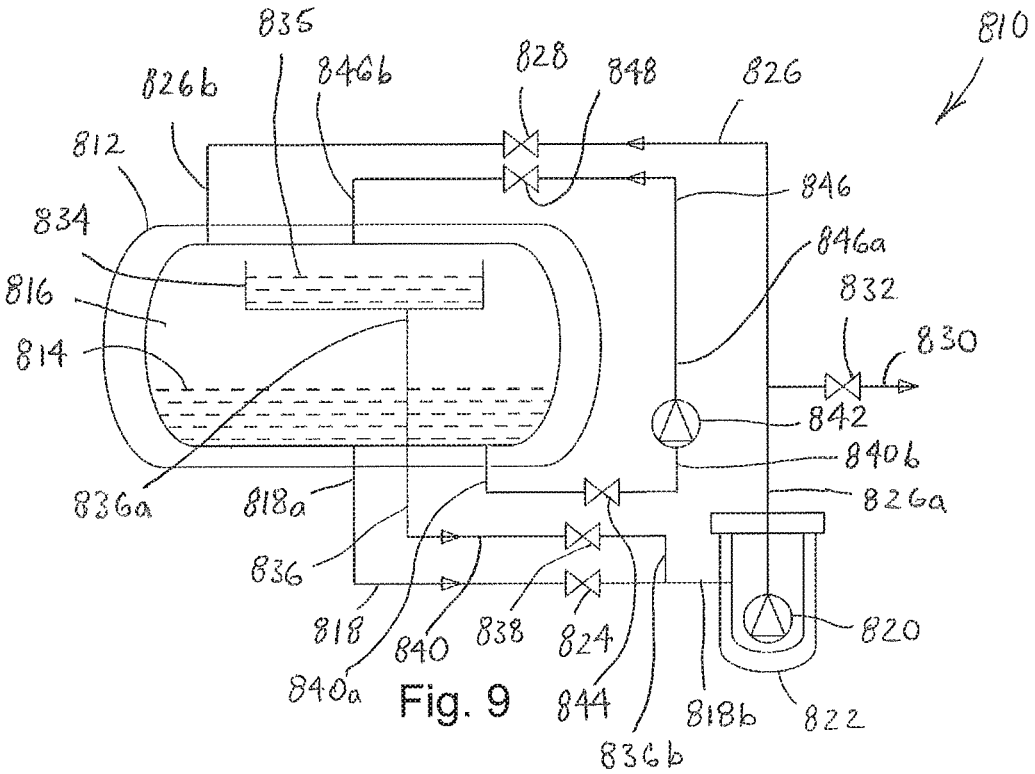
FIG. 9 is a schematic view of a second embodiment of a cryogenic liquid dispensing system in accordance with the invention and having a regular system pump that may recirculate liquid in the tank and a separate relatively smaller pump that may recirculate liquid to a basin in an upper portion of a tank.

A second example embodiment of a cryogenic liquid dispensing system 810 configured in accordance with the invention is indicated in FIG. 9, shown schematically as an LNG refueling station. The second example embodiment is similar to the first example embodiment, but the system 810 includes a relatively smaller pump that is dedicated to feeding liquid from the bottom of the tank to the raised basin, while the main pump can be used to recirculate liquid to the tank or to dispense liquid.

Thus, the cryogenic liquid dispensing system 810 includes a tank 812 defining an area that holds cryogenic liquid 814 with a vapor headspace 816 above the cryogenic liquid 814. A first supply conduit or line 818 is in liquid communication a first end 818*a* with a bottom portion of the tank 812 and is in liquid communication at a second end 818*b* with a pump 820 that is submerged in a separate vessel or sump 822. Liquid from tank 812 flows to sump 822 so as to be in liquid communication with the inlet of the pump 820 and to submerge the pump 820 in liquid to maintain adequate cooling of the pump 820. A first supply valve 824 is located in the first supply line 818 between the first end 818*a* of the first supply line 818 at the bottom portion of the tank 812 and the second end 818*b* of the first supply line 818 at the pump 820. One will appreciate that a liquid head is established by the relative difference in height at which the level of the cryogenic liquid 814 in the tank 812 is above the suction point for the pump 820, similarly to in the first example embodiment. Also, for the pump 820 to reliably operate, the liquid head must be greater than, or at least equal to a sum of the pump NPSH and the pressure loss experience by liquid flowing to the pump inlet.

A recycle conduit or line 826 is in liquid communication at a first end 826*a* with the pump 820 and is in liquid communication at a second end 826*b* with an upper portion of the tank 812, to permit recirculation of the cryogenic liquid by use of the main pump 820, if desired. Thus, a recycle valve 828 is located in the recycle line 826 between the first end 826*a* of the recycle line 826 at the pump 820 and the second end 826*b* at an upper position on the tank 812.

A basin 834 defining an area configured to hold cryogenic liquid 835 at a height raised above the bottom portion of the tank 812 is provided and the basin 834 is in liquid communication with the tank 812. The basin 834 is suspended within the tank 812 in an upper portion of the tank 812, and has an upward extending opening. A recirculation circuit is provided with a recirculation supply conduit or line 840 in liquid communication a first end 840*a* with a bottom portion of the tank 812 and is in liquid communication at a second end 840*b* with a recirculation pump 842. A recirculation supply valve 844 is located in the recirculation supply line 840 between the first end 840*a* at the bottom portion of the tank 812 and the second end 840*b* at the pump 842. It will be appreciated that the recirculation pump 842 is a relatively smaller pump that can have lower performance parameters than the regular main pump 820 because it is not used for dispensing. As such, the pump 842 also would have a smaller NPSH.

The recirculation circuit then can be completed by a recycle line 846, having a recycle valve 848 located in the recycle line 846 between the first end 846*a* of the recycle line 846 at the recirculation pump 842 and the second end 846*b* at the basin 834.

A dispensing conduit or line 830 is in liquid communication with the recycle line 826 at a location between the first end 826*a* at the pump 820 and the recycle valve 828. A dispensing valve 832 is located in the dispensing line 830 to control the flow of dispensed cryogenic liquid 814.

A second supply conduit or line 836 is in liquid communication at a first end 836*a* with a bottom portion of the basin 834 and is in liquid communication at a second end 818*b* with the pump 820. A second supply valve 838 is located in the second supply line 836 between a first end 836*a* at the bottom portion of the basin 834 and the second end 836*b* at the pump 820. One will appreciate that when drawing cryogenic liquid from the basin 834 through the second supply line 836, the liquid head established by the relative difference in height at which the level of the cryogenic liquid 835 in the basin 834 is above the suction point for the pump 820 will be greater than the liquid head otherwise would be when the cryogenic liquid is at a low level within the tank 812. One also will appreciate that the first and second supply valves 824 and 838 optionally may be replaced with a three-way valve.

The system 810 of the second example embodiment may be operated in a similar manner to the system 110 of the first example embodiment, but the relatively smaller pump 842 may be operated when the liquid in the tank falls below a desired level, so as to continue to utilize the cryogenic liquid in the tank 812 by drawing it from the raised basin 834 when the system would not otherwise provide a sufficient head pressure to dispense liquid.

Figure 10:
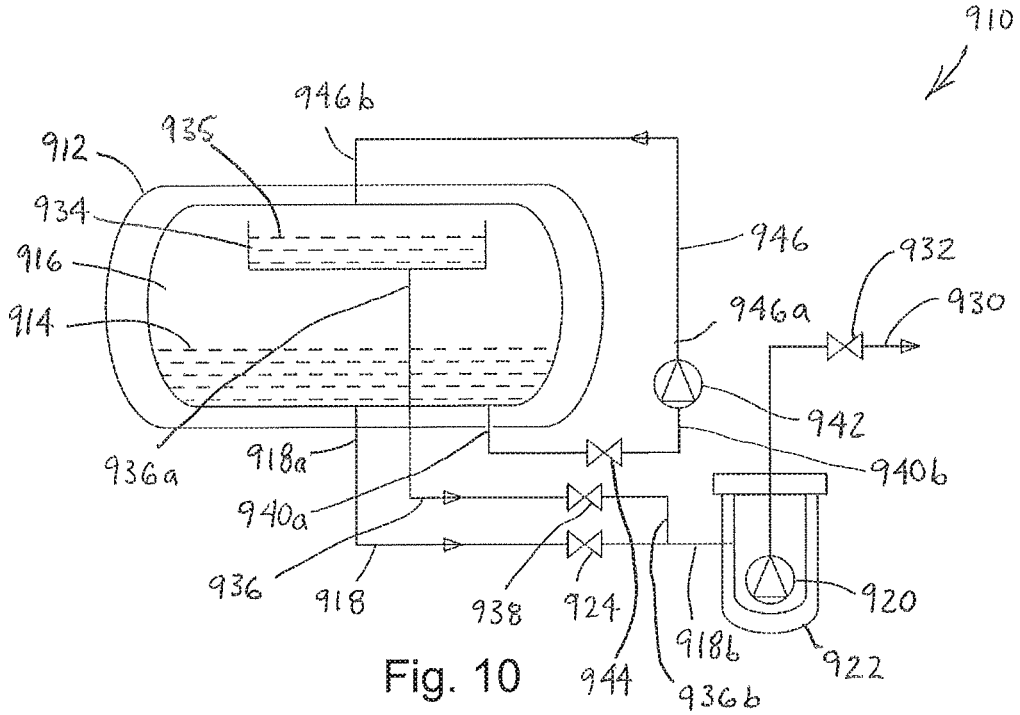
FIG. 10 is a schematic view of a third embodiment of a cryogenic liquid dispensing system in accordance with the invention and having a regular system pump used for dispensing liquid from the tank and a separate relatively smaller pump used to recirculate liquid to a basin in an upper portion of the tank.

A third example embodiment of a cryogenic liquid dispensing system 910 configured in accordance with the invention is indicated in FIG. 10, shown schematically as an LNG refueling station. The third example embodiment is similar to the first and second example embodiments, but the system 910 includes a relatively smaller pump that is dedicated to feeding liquid from the bottom of the tank to the raised basin, while the main pump does not include the potential to recirculate liquid, but rather is dedicated to being used to dispense the cryogenic liquid.

Accordingly, the cryogenic liquid dispensing system 910 includes a tank 912 defining an area that holds cryogenic liquid 914 with a vapor headspace 916 above the cryogenic liquid 914. A first supply conduit or line 918 is in liquid communication a first end 918*a* with a bottom portion of the tank 912 and is in liquid communication at a second end 918*b* with a pump 920 that is submerged in a separate vessel or sump 922. Liquid from tank 912 flows to sump 922 so as to be in liquid communication with the inlet of the pump 920 and to submerge the pump 920 in liquid to maintain adequate cooling of the pump 920. A first supply valve 924 is located in the first supply line 918 between the first end 918*a* of the first supply line 918 at the bottom portion of the tank 912 and the second end 918*b* of the first supply line 918 at the pump 920. One will appreciate that a liquid head is established by the relative difference in height at which the level of the cryogenic liquid 914 in the tank 912 is above the suction point for the pump 920, similarly to in the first example embodiment. Also, for the pump 920 to reliably operate, the liquid head must be greater than, or at least equal to a sum of the pump NPSH and the pressure loss experience by liquid flowing to the pump inlet.

A basin 934 defining an area configured to hold cryogenic liquid 935 at a height raised above the bottom portion of the tank 912 is provided and the basin 934 is in liquid communication with the tank 912. The basin 934 is suspended within the tank 912 in an upper portion of the tank 912, and has an upward extending opening. The system 910 of the third example embodiment does not include a recycle or recirculation circuit that utilizes the pump 920. Rather, a recirculation circuit is provided with a recirculation supply conduit or line 940 in liquid communication a first end 940*a* with a bottom portion of the tank 912 and is in liquid communication at a second end 940*b* with a recirculation pump 942. A recirculation supply valve 944 is located in the recirculation supply line 940 between the first end 940*a* at the bottom portion of the tank 912 and the second end 940*b* at the pump 942. The recirculation circuit then can be completed by a recycle line 946, extending from a first end 946*a* at the recirculation pump 942 and the second end 946*b* at the basin 934. It will be appreciated that the recirculation pump 942 is a relatively smaller pump that can have lower performance parameters than the regular main pump 920 because it is not used for dispensing. As such, the pump 942 also would have a smaller NPSH.

A dispensing conduit or line 930 is in liquid communication with the pump 920 and a dispensing valve 932 is located in the dispensing line 930 to control the flow of dispensed cryogenic liquid 914.

A second supply conduit or line 936 is in liquid communication at a first end 936*a* with a bottom portion of the basin 934 and is in liquid communication at a second end 918*b* with the pump 920. A second supply valve 938 is located in the second supply line 936 between a first end 836*a* at the bottom portion of the basin 934 and the second end 936*b* at the pump 920. One will appreciate that when drawing cryogenic liquid from the basin 934 through the second supply line 936, the liquid head established by the relative difference in height at which the level of the cryogenic liquid 935 in the basin 934 is above the suction point for the pump 920 will be greater than the liquid head otherwise would be when the cryogenic liquid is at a low level within the tank 912. One also will appreciate that the first and second supply valves 924 and 938 optionally may be replaced with a three-way valve.

The system 910 of the second example embodiment may be operated in a similar manner to the system 910 of the first example embodiment, but the relatively smaller pump 942 would provide all recirculation of liquid and always will feed the raised basin 934, so as to permit supply from the bottom of the tank 912, or from the raised basin 934 when the liquid in the tank falls below a desired level, so as to continue to utilize the cryogenic liquid in the tank 912 by drawing it from the raised basin 934 when the system would not otherwise provide a sufficient head pressure to dispense liquid.

In summary, adding a raised basin and a second supply line and supply valve permits cryogenic liquid to be pumped to a higher position, enhancing the ability to provide an adequate liquid head for a pump to reliably operate and dispense the cryogenic liquid otherwise not able to be removed from the tank. Also, as show in the example embodiments, pumping of the cryogenic liquid to the raised basis may be achieved by the system pump or by a relatively smaller separate pump, and if by a smaller pump, then the system may or may not provide for recirculation of cryogenic liquid to the tank via the relatively larger system pump.

These solutions that provide better utilization of the liquid in a tank could be applied to any horizontal tank for use in a cryogenic liquid dispensing system, but it also will be appreciated that the solutions may be applied to any vertical tank (a tank having a vertical cross-sectional area that is greater than its horizontal cross-sectional area) for use in a cryogenic liquid dispensing system.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A cryogenic liquid dispensing system comprising;

a. a tank defining an area and including a bottom portion that is configured to hold a first portion of cryogenic liquid;

b. a basin defining an area configured to hold a second portion of cryogenic liquid at a height raised above the bottom portion of the tank, and being in liquid communication with the tank;

c. a pump;

d. a first supply line in liquid communication with the bottom portion of the tank and the pump;

e. a first supply valve located in the first supply line between the bottom portion of the tank and the pump;

f. a recycle line in liquid communication with the pump and the basin;

g. a recycle valve located in the recycle line between the pump and the basin;

h. a dispensing line in liquid communication with the recycle line at a location between the pump and the recycle valve;

i. a dispensing valve in the dispensing line;

j. a second supply line in liquid communication with a bottom portion of the basin and the pump independent of the first supply line; and k. a second supply valve located in the second supply line between the bottom portion of the basin and the pump.

2. The cryogenic liquid dispensing system of claim 1 wherein the tank is a horizontal tank.

3. The cryogenic liquid dispensing system of claim 1 wherein the second supply line is in liquid communication with the first supply line at a location between the pump and the first supply valve.

4. The cryogenic liquid dispensing system of claim 1 wherein the basin is located outside the tank.

5. The cryogenic liquid dispensing system of claim 1 wherein the basin is located inside the tank.

6. The system of claim 1 wherein the first supply valve is separate and independent from the second supply valve.

7. The cryogenic liquid dispensing system of claim 5 wherein the basin is connected to a top portion of the tank.

8. The cryogenic liquid dispensing system of claim 5 wherein the basin is connected to a sidewall of the tank.

9. The cryogenic liquid dispensing system of claim 5 wherein the basin is connected to the bottom portion of the tank.

10. A method of dispensing a cryogenic liquid comprising the steps of:

a. opening a first supply valve in a first supply line in liquid communication with a pump and a tank defining an area and including a bottom portion that is configured to hold a first portion of cryogenic liquid;

b. opening a recycle valve in a recycle line in liquid communication with the pump and a basin defining an area configured to hold a second portion of cryogenic liquid, with the basin being located at a height raised above the bottom portion of the tank and being in liquid communication with the tank;

c. pumping cryogenic liquid from the bottom of the tank through the first supply line and the recycle line to the basin;

d. closing the recycle valve and opening a dispensing valve in a dispensing line that is in liquid communication with the recycle line at a location between the pump and the recycle valve with the level of cryogenic liquid in the bottom portion of the tank sufficient to permit reliable operation of the pump for dispensing cryogenic liquid;

e. pumping cryogenic liquid from the bottom portion of the tank, through the first supply line and first supply valve, the pump, and the dispensing line and dispensing valve;

f. when the level of cryogenic liquid in the bottom portion of the tank drops below the level required for reliable operation of the pump for dispensing, closing the first supply valve and opening a second supply valve located in a second supply line in liquid communication with a bottom portion of the basin and the pump independent of the first supply line; and g. pumping cryogenic liquid from the bottom of the basin and through the second supply line and second supply valve, the pump, and the dispensing line and dispensing valve.

11. The method of claim 10 further comprising the steps of:

h. when dispensing is completed closing the dispensing valve and the second supply valve;

i. opening the first supply valve and the recycle valve;

j. switching the pump to a lower speed and operating in recycling mode pumping liquid from the bottom portion of the tank to the basin;

k. closing the first supply valve and the recycle valve and opening the second supply valve; and l. pumping cryogenic liquid from the bottom of the basin and through the second supply line and second supply valve, the pump, and the dispensing line and the dispensing valve.

12. A cryogenic liquid dispensing system comprising;

a. a tank defining an area and including a bottom portion that is configured to hold a first portion of cryogenic liquid;

b. a basin defining an area configured to hold a second portion of cryogenic liquid at a height raised above the bottom portion of the tank, and being in liquid communication with the tank;

c. a first pump;

d. a first supply line in liquid communication with the bottom portion of the tank and the first pump;

e. a first supply valve located in the first supply line between the bottom portion of the tank and the first pump;

f. a recycle line in liquid communication with the first pump and an upper portion of the tank;

g. a recycle valve located in the recycle line between the first pump and the upper portion of the tank;

h. a dispensing line in liquid communication with the recycle line at a location between the first pump and the recycle valve;

i. a dispensing valve in the dispensing line;

j. a second supply line in liquid communication with a bottom portion of the basin and the first pump independent of the first supply line;

k. a second supply valve located in the second supply line between the bottom portion of the basin and the first pump l. a second pump that is relatively smaller than the first pump;

m. a first recirculation line in liquid communication with the bottom portion of the tank and the second pump;

n. a first recirculation valve located in the first recirculation line between the bottom portion of the tank and the second pump; and o. a second recirculation line in liquid communication with the second pump and the basin.

13. The cryogenic liquid dispensing system of claim 12 further comprising a second recirculation valve located in the second recirculation line in liquid communication with the second pump and the basin.

14. The system of claim 12 wherein the first supply valve is separate and independent from the second supply valve.

15. A cryogenic liquid dispensing system comprising;

a. a tank defining an area and including a bottom portion that is configured to hold a first portion of cryogenic liquid;

b. a basin defining an area configured to hold a second portion of cryogenic liquid at a height raised above the bottom portion of the tank, and being in liquid communication with the tank;

c. a first pump;

d. a first supply line in liquid communication with the bottom portion of the tank and the first pump;

e. a first supply valve located in the first supply line between the bottom portion of the tank and the first pump;

f. a second pump that is relatively smaller than the first pump;

g. a recycle line in liquid communication with the bottom portion of the tank and the basin;

h. the second pump located in the recycle line between the bottom portion of the tank and the basin;

i. a recycle valve located in the recycle line between the bottom portion of the tank and the second pump;

j. a second supply line in liquid communication with a bottom portion of the basin and the first pump independent of the first supply line;

k. a second supply valve located in the second supply line between the bottom portion of the basin and the first pump;

l. a dispensing line in liquid communication with the first pump; and m. a dispensing valve in the dispensing line.

16. The system of claim 15 wherein the first supply valve is separate and independent from the second supply valve.

17. A cryogenic liquid dispensing system comprising;

a. a tank defining an area and including a bottom portion that is configured to hold a first portion of cryogenic liquid;

b. a basin defining an area configured to hold a second portion of cryogenic liquid at a height raised above the bottom portion of the tank, and being in liquid communication with the tank;

c. a pump;

d. a first supply line in liquid communication with the bottom portion of the tank and the pump;

e. a three-way supply valve in fluid communication with the first supply line between the bottom portion of the tank and the pump;

f. a recycle line in liquid communication with the pump and the basin;

g. a recycle valve located in the recycle line between the pump and the basin;

h. a dispensing line in liquid communication with the recycle line at a location between the pump and the recycle valve;

i. a dispensing valve in the dispensing line;

j. a second supply line in liquid communication with a bottom portion of the basin and the pump independent of the first supply line; and k. said three-way supply valve in fluid communication with the second supply line between the bottom portion of the basin and the pump.

18. The cryogenic liquid dispensing system of claim 17 wherein the basin is located outside the tank.

19. The cryogenic liquid dispensing system of claim 17 wherein the basin is located inside the tank.

20. The cryogenic liquid dispensing system of claim 19 wherein the basin is connected to a top portion of the tank.

* * * * *